US006406161B1

(12) United States Patent
Lin et al.

(10) Patent No.: US 6,406,161 B1
(45) Date of Patent: Jun. 18, 2002

(54) ILLUMINATION DEVICE FOR A NOTEBOOK COMPUTER

(75) Inventors: Chih-Hong Lin, Taipei; Mao-Sung Wu, Taoyuan Hsien, both of (TW)

(73) Assignee: Senton Enterprise Co., Ltd. (TW)

( * ) Notice: Subject to any disclaimer, the term of this patent is extended or adjusted under 35 U.S.C. 154(b) by 0 days.

(21) Appl. No.: 09/750,775

(22) Filed: Jan. 2, 2001

(30) Foreign Application Priority Data

Dec. 15, 2000 (TW) ..... 89221835 U

(51) Int. Cl.[7] ..... F21V 33/00

(52) U.S. Cl. ..... 362/85; 362/287; 362/427; 362/250

(58) Field of Search ..... 362/85, 287, 427, 362/109, 253, 198, 197, 199, 250

(56) References Cited

U.S. PATENT DOCUMENTS 5,034,865 A * 7/1991 Soneman ..... 362/226
5,615,945 A * 4/1997 Tseng ..... 362/226
5,868,487 A * 2/1999 Polley et al. ..... 362/109
D435,679 S * 12/2000 Naghi et al. ..... D25/103
6,168,292 B1 * 1/2001 Sherman ..... 362/287
6,186,636 B1 * 2/2001 Naghi et al. ..... 362/85

* cited by examiner

*Primary Examiner*—Thomas M. Sember
(74) *Attorney, Agent, or Firm*—Troxell Law Office PLLC

(57) ABSTRACT

An illumination device for a notebook computer comprises a base, a support arm, and a light body. The base is flat with the front end having a size corresponding to a PCMCIA interface slot in the notebook computer. An electricity fetching plug connector is provided at the front end with an electric wire extended in the base. The plug connector is corresponding to a power source terminal in the PCMCIA interface slot of the notebook computer. The support arm has an end thereof provides a pivot joint attached to the upper side of the base for being able to performing angular movement upward and downward. The other end of the support arm provides a support joint. The light body has a lamp shield connecting with the support joint and at least an illuminator is disposed under the lamp shield. The illuminator provides an electric wire to connect with the preceding electric wire in the base.

8 Claims, 2 Drawing Sheets

ILLUMINATION DEVICE FOR A NOTEBOOK COMPUTER

BACKGROUND OF THE INVENTION

1. Field of the Invention

The present invention relates to an illumination device in a notebook computer, and particularly to an illumination device, which is possible to fit with the PCMCIA interface slot in the notebook computer easily to enhance the illumination required by the notebook computer.

2. Description of Related Art

The computer is frequently used in our daily life and provides us a great convenience. Traditional manual works such as mathematical operation, and file management, storage and search can be performed in the computer effectively so as to result in the promotion of work efficiency. Therefore, they say the development of the computer basically is another industrial revolution.

Due to the increasing progress of the material science and the machining technology, the information industry such as the hardware of computer is aimed to pursue lightness, shortness, thinness, and little-ness. Further, the periphery for the computer is developed accordingly. The notebook computer is a typical example and the portable computer has broken through the disadvantage of the unmovable tabletop computer. In practice, the notebook computer adapting with a power source arrangement can be placed at any space theoretically.

Accordingly, the notebook computer makes the information record, and storage for outdoor works such as exercise training, countryside investigation, mountain climbing, camping, and etc possible. Also, taking the advantage of notebook computer makes outdoor works convenient and speedily so that the mobility and the efficiency can be promoted conspicuously.

On the other hand, the notebook computer mostly is provided with a keyboard for data input so that the user has to have the skill of operating the keyboard. In fact, a non-professional operator of keyboard would be slower in the speed of data input.

For a non-professional operator of keyboard such as a researcher, it is all right for him/her to key in data indoors with a sufficient illumination while the notebook is used. However, it becomes a hard job for him/her to operate the keyboard outdoors without sufficient illumination especially at night. The only way to do is to count on the dim light of display on the notebook while operating the keyboard with inexperienced skill. Therefore, working with the notebook computer under the circumstance of no sufficient light makes them a lot of trouble.

SUMMARY OF THE INVENTION

An object of the present invention is to provide a foldable illumination device for a notebook computer, which offers an elongated flat base with a connector end fitting with the PCMCIA interface slot provided in the notebook computer for adding the illumination in addition to the light emitting from the display of the notebook itself during the computer in a state of running.

BRIEF DESCRIPTION OF THE DRAWINGS

The present invention can be more fully understood by referring to the following description and accompanying drawings, in which.

DETAILED DESCRIPTION OF THE PREFERRED EMBODIMENTS

Figure 1:
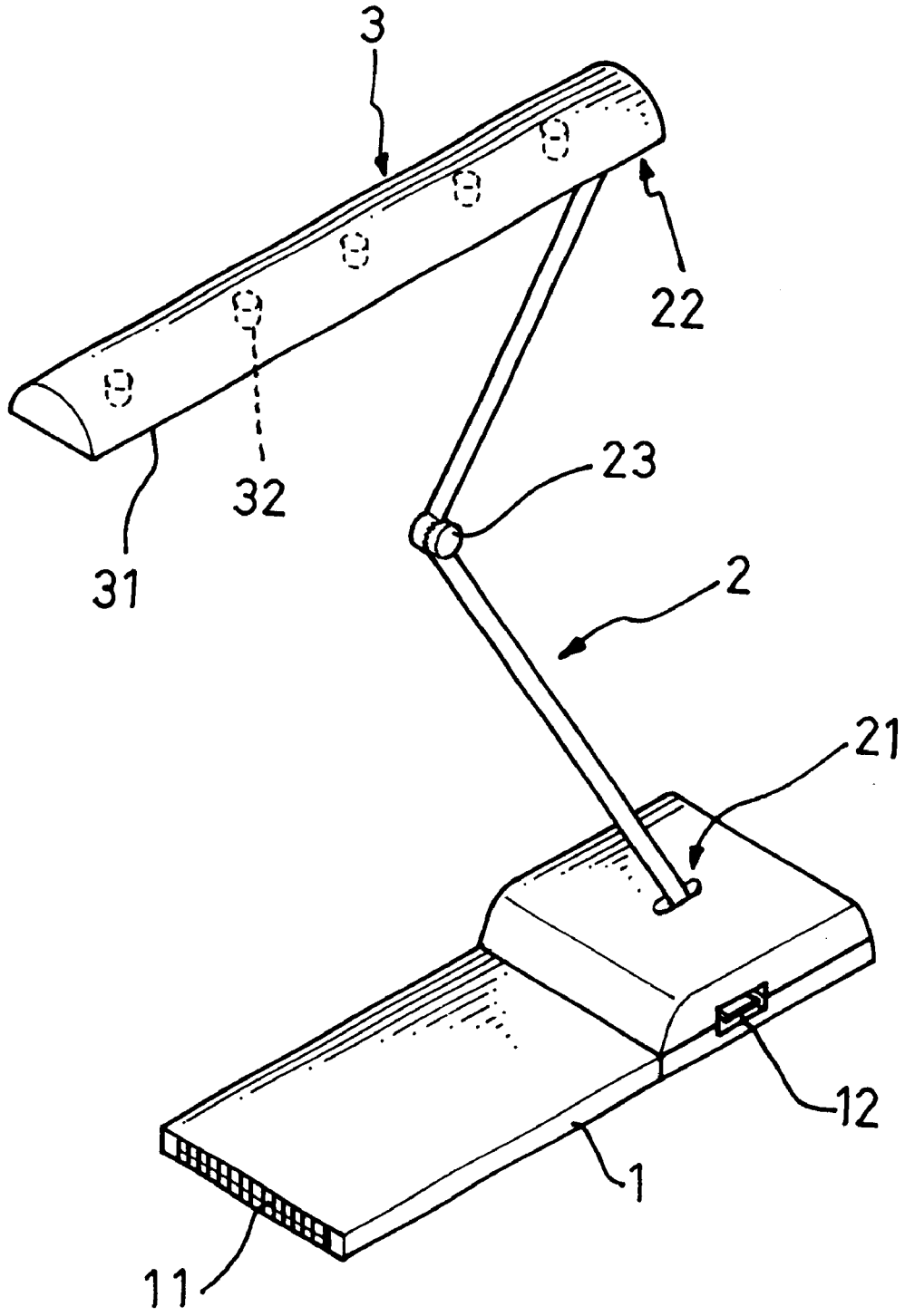
FIG. 1 is a perspective view of an illumination device for a notebook computer in accordance with the present invention.
Figure 2:
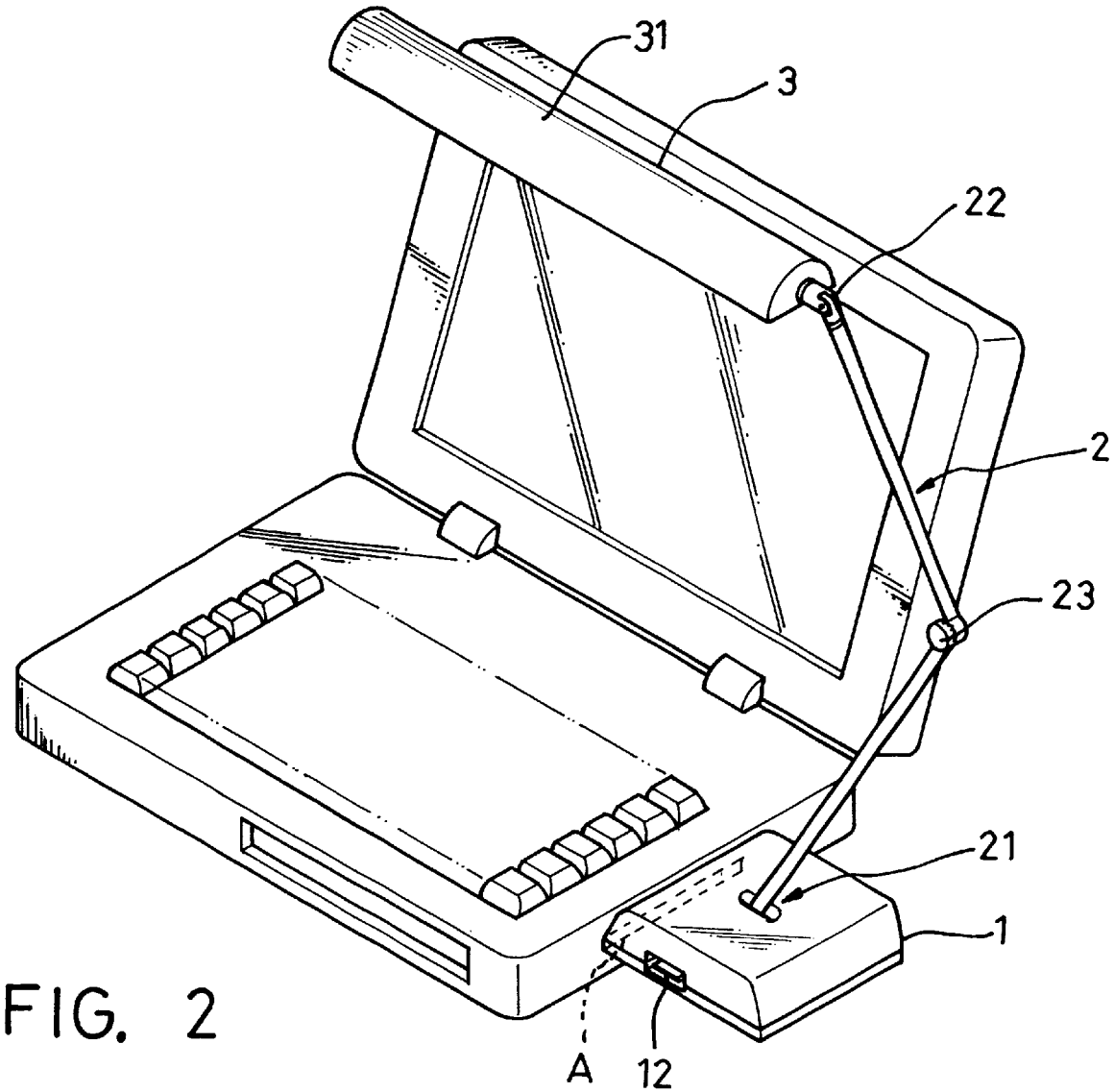
FIG. 2 is a perspective view illustrating the illumination device shown in FIG. 1 having been attached to a notebook computer.

Referring to FIGS. 1 and 2, the concept of the invention is derived from utilizing the PCMCIA interface slot in a notebook computer as a power source for an illumination device. The PCMCIA interface slot is a standardized specification adaptable for all types of notebook computers.

Basically, as shown in FIG. 1, the illumination device of the present invention comprises a base 1, a support arm 2, and a light body 3.

The base 1 is configured to be a flat shape and an end of the base 1 is provided with an electricity fetching connector 11 for being inserted into a PCMCIA interface slot A shown in FIG. 2. Because the connector 11 can connect with the power source terminal in a slot connector to constitute a close circuit, the electricity can be fetched through the connector 11 and this is the reason why the connector 11 is designated as electricity fetching connector. Meanwhile, the size of the end with connector 11 is corresponding to the slot A of PCMCIA interface such that the connector 11 can be located in the slot A properly. The base 1 at the other end part thereof joins the support arm 2. Further, the base 1 therein is provided with circuit to connect with the connector 11 and it is possible to provide a switch and a self-power source such as a battery case for receiving at least a battery. It should be noted that this is the prior art and no detail will be described further. In addition, a lateral side of the base 1 may be provided with a USB connector 12 as an auxiliary device for fetching the electricity while the PCMCIA interface is in a state of being occupied. Moreover, a switch may be mounted between connector 11 and the connector 12 for switching the power source. This is the prior art either and no detail will be described further.

The support arm 2 is a hollow or solid elongated rod with a single piece or two or more foldable sections. Basically, an end of the support arm 2 has a base joint 21 to pivotally engage with the base 1 by way of a transverse pivot urged by a spring or other equivalent device so as to perform angular adjustment. The other end of the support arm 2 has a support joint 22 to pivotally engage with the light body 3 so as to perform angular movement and/or up and down adjustment. As illustrated in FIG. 1, the support arm 2 is provided with a foldable intermediate joint 23, thereby an upper section and a lower section of the support arm 2 are possible to be adjustably folded to each other. The preceding electrical wire from the base 1 can be arranged to extend along the inner side of the support arm 2. Alternately, the electrical wire may be arranged to extend along outer side of the support arm 2, but, the exposed electrical wire may cause a undesirable sense of vision.

The light body 3 is composed of a lamp shield 31 and an illuminator 32 attached to the lower part of the lamp shield 31. The light body 3 is electrically connects with the wire from the support arm 2 so as to form a close circuit. If multiple light bodies 3 are arranged, a parallel circuit can be applied to connect these light bodies 3. The light body 3 can be a traditional little light bulbs or LED (light emitting diode), and it is preferable that a white LED is utilized due to an excellent brightness being reached between DC 3V to 5V.

In case of the illumination device of the present invention being not in use, the support arm 2 as shown in FIG. 1 can be folded to each other toward the base 1 such that the light body 3 is adjusted to lay next to the base 1. Thus, the illumination device can be configured as being in a state of thin shape.

In case of the illumination device of the present invention being in use, the electricity fetching connector 11 of the base 1 is inserted into and engages with the PCMCIA interface slot A so as to located at the notebook computer. In the meantime, the illuminator 32 may be lit up and a best illuminating effect may be obtained properly by way of the adjustment of the support arm 2 and the light body 3.

It is appreciated that the present invention provides a simple illumination device, which can be attached to a notebook computer easily to solve a problem of insufficient light source having resided in the notebook computer for a long time. Accordingly, the present invention has offered an excellent auxiliary illumination and is a great breakthrough of periphery product for the notebook computer.

While the invention has been described with reference to the preferred embodiments thereof, it is to be understood that modifications or variations may be easily made without departing from the spirit of this invention, which is defined by the appended claims.

What is claimed is:

1. An illumination device for a notebook computer, comprising:

a base with an upper side, the base being flat with an end configured to insert into a PCMCIA interface slot in the notebook computer, the end being provided an electricity fetching plug connector corresponding to a power source terminal in the PCMCIA interface slot;

a support arm with two ends, one of said two ends pivotally attached to the upper side of the base for angular movement with respect to the base, another one of said two ends having a support joint;

a light body, having a lamp shield connecting with the support joint, the light body having at least one illuminator disposed under the lamp shield, and the at least one illuminator being electrically connected with the plug connector in the base; and, a USB connector provided on the base.

2. The illumination device for a notebook computer as defined in claim 1, further comprising a control switch to control electrical connection between the plug connector and the at least one illuminator.

3. The illumination device for a notebook computer as defined in claim 1, wherein the support arm comprises at least two sections connected by an intermediate joint.

4. The illumination device for a notebook computer as defined in claim 1, wherein the illuminator is an LED.

5. The illumination device for a notebook computer as defined in claim 1, wherein the light body includes at least two illuminators connected in a parallel circuit.

6. The illumination device for a notebook computer as defined in claim 1, further comprising an electric wire connecting the plug connector and the light body wherein the electric wire extends internally through the support arm.

7. The illumination device for a notebook computer as defined in claim 1, wherein the support joint comprises a pivot joint enabling the lamp shield and the support arm to be angularly adjustable.

8. The illumination device for a notebook computer as defined in claim 1, wherein the lamp shield can be moved transversely with respect to the support arm.

* * * * *